US006064404A

United States Patent [19]

Aras et al.

[11] Patent Number: 6,064,404

[45] Date of Patent: May 16, 2000

[54] BANDWIDTH AND FRAME BUFFER SIZE REDUCTION IN A DIGITAL PULSE-WIDTH-MODULATED DISPLAY SYSTEM

[75] Inventors: Richard John Edward Aras, Santiago, Chile; Paul A. Alioshin, San Francisco, Calif.

[73] Assignee: Silicon Light Machines, Sunnyvale, Calif.

[21] Appl. No.: 08/744,099

[22] Filed: Nov. 5, 1996

[51] Int. Cl.[7] ..... G09G 3/34

[52] U.S. Cl. ..... 345/507; 345/509; 345/210; 395/116

[58] Field of Search ..... 345/89, 147, 148, 345/189, 199, 200, 507, 509, 510; 358/444, 524; 395/115, 116; 382/305

[56] References Cited

U.S. PATENT DOCUMENTS

| | | | |
|---|---|---|---|
| 3,947,105 | 3/1976 | Smith | 353/121 |
| 4,009,939 | 3/1977 | Okano | 350/162 SF |
| 4,017,158 | 4/1977 | Booth | 350/162 SF |
| 4,067,129 | 1/1978 | Abramson et al. | 40/563 |
| 4,093,346 | 6/1978 | Nishino et al. | 350/162 SF |
| 4,139,257 | 2/1979 | Matsumoto | 350/6.1 |
| 4,163,570 | 8/1979 | Greenaway | 283/8 A |
| 4,184,700 | 1/1980 | Greenaway | 283/6 |

(List continued on next page.)

FOREIGN PATENT DOCUMENTS

| | | | |
|---|---|---|---|
| 0 261 901 | 3/1988 | European Pat. Off. | G09G 3/36 |
| 0 488 326 A3 | 6/1992 | European Pat. Off. | G09G 3/28 |
| 0 530 760 | 3/1993 | European Pat. Off. | G09G 3/34 |
| 0 654 777 A1 | 5/1995 | European Pat. Off. | G09G 3/34 |
| 2-219092 | 8/1990 | Japan | G09G 3/28 |
| WO 92/12506 | 7/1992 | WIPO | G09F 9/37 |

OTHER PUBLICATIONS

R. Apte, F. Sandejas, W. Banyai, D. Bloom, "Grating Light Valves For High Resolution Displays," Ginzton Laboratories, Stanford University, Stanford, CA 94305–4085.

R. Apte, *Grating Light Valves For High Resolution Displays,* Jun., 1994.

(List continued on next page.)

*Primary Examiner*—Mark K. Zimmerman
*Assistant Examiner*—Vincent E. Kovalick
*Attorney, Agent, or Firm*—Haverstock & Owens LLP

[57] ABSTRACT

A method and apparatus are used for converting a stream of incoming serial video data which is received frame by frame and is formatted with all data bits arriving together for each pixel into digital PWM video formatted as a sequence of like-weighted bits. Incoming video data is temporarily stored in a digital memory. A controller organized the data in the memory into a plurality of buffers, each buffer having only bits of like weight. The data is collected as groups within the buffers. The data is then coupled to a display device as the groups of like-weighted bits after a predetermined fraction of a frame time for producing the desired PWM signal. Since each bit of the incoming video data is stored for a fraction of a frame time, the present invention facilitates decimation of the total amount of buffer memory, compared to that of the prior art. A method of and apparatus are used for converting a stream of incoming serial PWM video data which is received frame by frame and is organized with all data for a single pixel transmitted concurrently into digital PWM video organized into groups of like-weighted bits. Once the stream of incoming serial PWM video data is received it is stored in a digital memory. A controller organized the data in the memory into a plurality of bit planes, each bit plane having only bits of like weight. The data is collected as groups within the bit planes. The data is coupled to a display device as groups of like-weighted bits. As groups of the shortest duration bit weight are formed, they are coupled to the display. This allows less than an entire frame of data to be stored.

24 Claims, 7 Drawing Sheets

U.S. PATENT DOCUMENTS

| | | | |
|---|---|---|---|
| 4,211,918 | 7/1980 | Nyfeler et al. | 235/454 |
| 4,223,050 | 9/1980 | Nyfeler et al. | 427/163 |
| 4,250,217 | 2/1981 | Greenaway | 428/161 |
| 4,250,393 | 2/1981 | Greenaway | 250/566 |
| 4,408,884 | 10/1983 | Kleinknecht et al. | 356/355 |
| 4,440,839 | 4/1984 | Mottier | 430/2 |
| 4,492,435 | 1/1985 | Banton et al. | 350/360 |
| 4,556,378 | 12/1985 | Nyfeler et al. | 425/143 |
| 4,596,992 | 6/1986 | Hornbeck | 346/76 PH |
| 4,655,539 | 4/1987 | Caulfield et al. | 350/3.6 |
| 4,709,995 | 12/1987 | Kuribayashi et al. | 350/350 S |
| 4,747,671 | 5/1988 | Takahashi et al. | 350/336 |
| 4,751,509 | 6/1988 | Kubota et al. | 340/784 |
| 4,761,253 | 8/1988 | Antes | 264/1.3 |
| 4,856,869 | 8/1989 | Sakata et al. | 350/162.18 |
| 4,915,463 | 4/1990 | Barbee, Jr. | 350/1.1 |
| 4,984,824 | 1/1991 | Antes et al. | 283/91 |
| 5,035,473 | 7/1991 | Kuwayama et al. | 350/3.7 |
| 5,058,992 | 10/1991 | Takahashi | 359/567 |
| 5,089,903 | 2/1992 | Kuwayama et al. | 359/15 |
| 5,101,184 | 3/1992 | Antes | 235/454 |
| 5,132,812 | 7/1992 | Takahashi et al. | 359/9 |
| 5,155,604 | 10/1992 | Miekka et al. | 359/2 |
| 5,231,388 | 7/1993 | Stolz | 340/783 |
| 5,291,317 | 3/1994 | Newswanger | 359/15 |
| 5,301,062 | 4/1994 | Takahashi et al. | 359/567 |
| 5,311,360 | 5/1994 | Bloom et al. | 359/572 |
| 5,347,433 | 9/1994 | Sedlmayr | 362/32 |
| 5,363,220 | 11/1994 | Kuwayama et al. | 359/3 |

OTHER PUBLICATIONS

O. Solgaard, *Integrated Semiconductor Light Modulators For Fiber–Optic And Display Applications,* Feb. 1992.

J. Neff, "Two–Dimensional Spatial Light Modulators: A Tutorial," *Proceedings of the IEEE,* vol. 78, No. 5 (May 1990), pp. 826–855.

Gerhard–Multhaupt, "Viscoelastic Spatial Light Modulators and Schlieren–Optical Systems for HDTV Projection Displays", *SPIE vol. 1255 Large Screen Projection Displays II* (1990), pp. 69–78.

Gerhard–Multhaupt, "Light–Valve Technologies for High–Definition Television Projection Displays", *Displays,* vol. 12, No. 3/4 (1991), pp. 115–128.

BANDWIDTH AND FRAME BUFFER SIZE REDUCTION IN A DIGITAL PULSE-WIDTH-MODULATED DISPLAY SYSTEM

FIELD OF THE INVENTION

This invention relates to the field of digital display systems using pulse width modulation to affect grayscale or color images in still and video sequences. More particularly, this invention relates to a method of and an apparatus for interfacing conventional video signal formats to spatial light modulator devices in such a system to reduce both bandwidth and frame buffer size.

BACKGROUND OF THE INVENTION

According to conventional practice, and due largely to the historical dominance of cathode ray tube displays, video signals are formatted for broadcast or communication to display devices by a process of serialization. For convenience, such displays will be referred to herein as serial displays. Each successive two-dimensional picture or frame in a serial display is scanned in a repeating zigzag pattern along horizontal lines and vertically down the picture in successive lines. At each point in time, the color and intensity for a particular position on the display is defined in the video signal. This signal is digitized, and is also typical of direct digital sources such as MPEG decoders and computer display subsystems. This is to say that conventional temporal ordering of the two-dimensional picture data is preserved when an analog signal is digitalized, and is also typical of direct digital sources such as MPEG decoders and computer display subsystems. This is to say that conventional video ordering (and display) is such that the bits making up a pixel's data word are communicated together in time; pixels are communicated one after another to form a line; the line sequence of successive lines defines frames; a full video sequence is defined frame by frame. Thus, the image data is received at the scan rate of such a conventional display device. Because of this there is no need to store the image data in an ordinary television or similar display device.

So-called digital displays are now well known in the art. When displaying an image using a digital display device, a data bit defines the state of each picture element (pixel). Thus, each pixel is either 'on' or 'off' according to the binary state of the data bit. To form a more variable image it is desirable to provide selectable grayscale using pulse width modulation (PWM) and such increased variability can be used to provide more information or more realism in an image. For example, consider a display where an 'on' pixel is white and an 'off' pixel is black. To achieve an in-between state, e.g. gray, the pixel can be toggled equally between 'on' and 'off'. If the pixel display duration is sufficiently short, the viewer's eye/brain system automatically integrates this toggled pixel to perceive a gray image rather than black and white. To achieve a lighter or darker gray, the duty cycle for toggling the pixel can be adjusted so the pixel is on more or less of the time according to the state of a multiple corresponding bits of a signal word. In other words the width of the 'on' pulse is adjusted (modulated) in relation to the width of the 'off' pulse to alter the degree of brightness/darkness of the pixel.

The techniques for using PWM to generate grayscale are directly applicable to technologies using PWM to generate color in display technologies. To avoid obscuring the present invention in unnecessary and extraneous detail, some portions of the prior art and the invention will be described relative to the formation of a black and white grayscale display only. It will be apparent to one of ordinary skill in the art that these techniques can be directly applied to forming a color display combination using primary colors. It will be understood that color is also contemplated within the teachings of the invention.

Weighted PWM schemes modulate an output by utilizing a display duration divided into smaller segments of varying durations. A bit's weight is governed by the time a data value is present on a pixel, that is, the time between being written and later overwritten. Conventional schemes use a binary radix number coding and weighing where each bit in the pixel's signal word has half the weight of its predecessor and the corresponding segments duration is scaled in the same manner. The modulated signals activated during all, some or none of the segments in the frame to develop a signal representing a particular parameter. This method and apparatus can be used in a display for selecting among varying levels of gray. Conventionally, a binary weighted grayscale can select among $2^n$ levels of gray where n is the number of bits in the binary weighting.

One type of digital displays are known as silicon light modulators. One example of a silicon light modulator is taught in U.S. Pat. No. 5,311,360 issued May 10, 1994 to Bloom, et al. which is incorporated herein by reference. Another silicon light modulator is taught by European Patent application serial number EP-94100308, and applied for by Texas Instruments. Unlike the serial displays of the prior art, this type of digital display does not update the display one pixel at a time. In one type of display taught by Texas Instruments, all the pixels of the array are simultaneously updated. For a present day high resolution display having 1024×1280 pixels, and consequently 1,310,720 pixels need to be updated at a time.

For this reason among others, certain silicon light modulator arrays (in the form of chips or components) are updated in groups of pixels rather than all pixels of the arrays at once, thus alleviating much of the interconnection and bandwidth problems associated with transferring a million or more data bits at once. For example, see U.S. patent application Ser. No. 08/473,750 filed Jun. 7, 1995 and also U.S. patent application Ser. No. 08/635,479, filed Apr. 22, 1996, both incorporated herein by reference. An update is the event by which such a group of data is transferred to the light modulator and is displayed. The ordering of update events in time—commonly referred to as 'addressing'—generates the desired PWM effect such that an update punctuates a previous update's time period by overwriting old data and initiating a new time period. In U.S. Pat. No. 5,311,360 the silicon light modulator comprises a Grating Light Valve (GLV). In that reference for instance, a group comprises a complete horizontal line or "row" of pixels and a row is updated in parallel.

As discussed above, in a PWM video display system the bits in the digital data word defining the gray level of a particular pixel arrive in a serial data stream, pixel by pixel. However, in a silicon light modulator, the data updates occur at various points in time dispersed through the frame period. Therefore, when displaying a conventional video source on a digital PWM display, buffer memories are required to interface between the incoming video and the silicon light modulator. An incoming video signal is generally not PWM, but rather is digitally coded, generally binary. The video display signal is PWM. A typical relationship between incoming video data timing and displayed data timing is illustrated in FIG. 1 for a 4-bit grayscale. Note that the most significant bit (MSB) of data from line 0 cannot be used in a display update until data from line 1023 has been received; line 0 MSB and all intermediate data values have to be stored in the mean time.

Interfacing between the incoming video and the silicon light modulator, according to conventional practice, a double-buffered frame store is used. Here, one memory bank is written with data from an incoming video frame, while data from the preceding frame is simultaneously read from the second bank. At the end of the frame time, the banks' functions are interchanged: the bank previously written is now read out, while the bank previously read is now overwritten with new frame date. Such a system must have sufficient memory capacity to hold two complete frames of video information. In the high resolution 1024×1280 and consequently for the system discussed above, information for two times 1,310,720 pixels (2,621,440 pixels) are stored. In an eight bit grayscale PWM system, these frame buffers must contain data storage for 20,971,520 bits. Color systems conventionally have three times that requirement for data storage. Additionally, the memory system requires a sustained bandwidth of 700 megabytes/second or above counting both read and write accesses in a color 1024×1280 color system. An implementation according to these requirements will be very expensive using commercially available RAM components. Previous disclosures have described optimizations for silicon light modulator device simplification, peak bandwidth reductions for buffer memory and silicon light modulator interfacing, but have assumed or described double buffered frame stores as part of the drive system.

Additionally, throughout the duration of the frame period, a complete frame's data is available for forming a corresponding PWM display addressing scheme. In other words, once all the data for a single frame is stored, the like-weighted bits for a group, such as a row, are collected and simultaneously displayed in that row. Thus, not only must such a system have the significant memory storage capability described above, but that memory must have a combined read-write bandwidth capability to supporting a least twice the incoming video data rate. In such systems this requires a sustained bandwidth of 750 megabytes/second. or more (20 costly memory chips in current technology). Previous disclosures have described optimization for silicon light modulator device simplification, peak bandwidth reduction for buffer memory and silicon light modulator interfacing, but have assumed or described double buffered frame stores as part of the drive system.

What is needed is a digital display system providing PWM grayscale and/or color which does not require the support of a fully double-buffered, high-speed frame store memory in order to interface with conventional video sources.

SUMMARY OF THE INVENTION

A method and apparatus are used for converting a stream of incoming serial video data which is received frame by frame and is formatted with all data bits arriving together for each pixel into digital PWM video formatted as a sequence of like-weighted bits. Incoming video data is temporarily stored in a digital memory. A controller organizes the data in the memory into a plurality of buffers, each buffer having only bits of like weight. The data is collected as groups within the buffers. The data is then coupled to a display device as the groups of like-weighted bits after a predetermined fraction of a frame time for producing the desired PWM signal. Since each bit of the incoming video data is stored for a fraction of a frame time, the present invention facilitates decimation of the total amount of buffer memory, compared to that of the prior art.

The first aspect of the invention is circuitry that divides incoming video data words into a number of logically separate bit channels. Data in these bit channels stream into variously sized buffers arranged such that each buffer has only the necessary capacity to delay data until it is displayed. After a data item has been transferred to the silicon light modulator and displayed in an update cycle, the memory cells which stored that data item is freed and to be reused for a new incoming data item.

The silicon light modulator addressing scheme may be arranged such that the number of buffer channels, N, is equal to the number of bits in the binary PWM grayscale data word and will never be larger than the number of bits of information defining the displayed image.

In cases where N is small, the complexity of addressing and control circuitry reduced. Double buffering of complete video frames is obviated, and instead, buffers may conveniently be implemented as first-in first-out memories (FIFOs) or multiple circular buffers in a single bulk memory device such as a low cost DRAM. An advantage of the invention is lowered system cost.

The present invention is particularly suited for use with optimized addressing schemes such as that disclosed in our co-pending application Ser. No. 08/635,479, filed Apr. 22, 1996. This combination provides for minimizing the total buffer capacity requirements by reducing the average delay of data before it is displayed.

DETAILED DESCRIPTION OF THE PREFERRED EMBODIMENT

Figure 1:
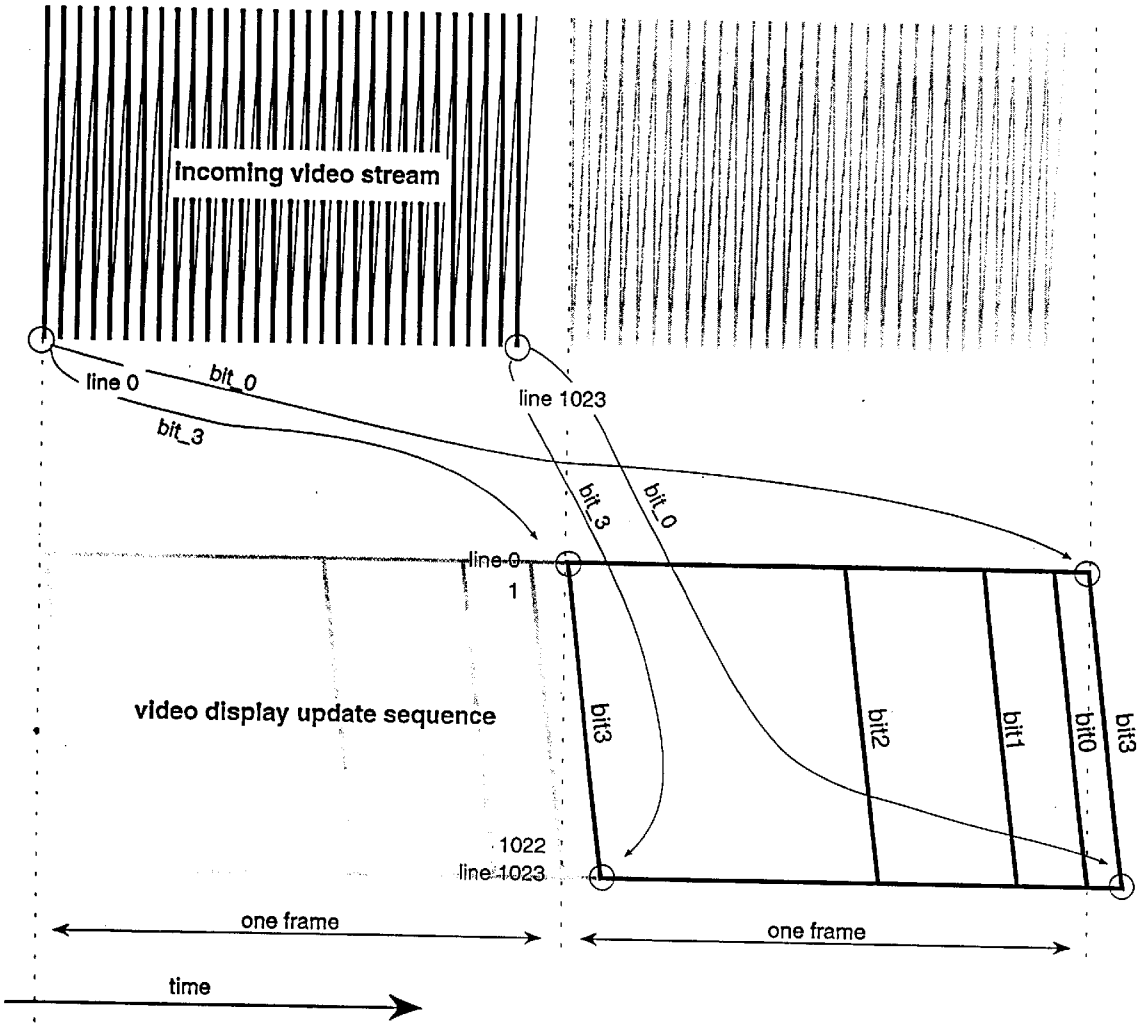
FIG. 1 illustrates a typical video timing relationship of the prior art showing the temporal relationship between incoming video data and output of that data is silicon light modulator updates.
Figure 2:
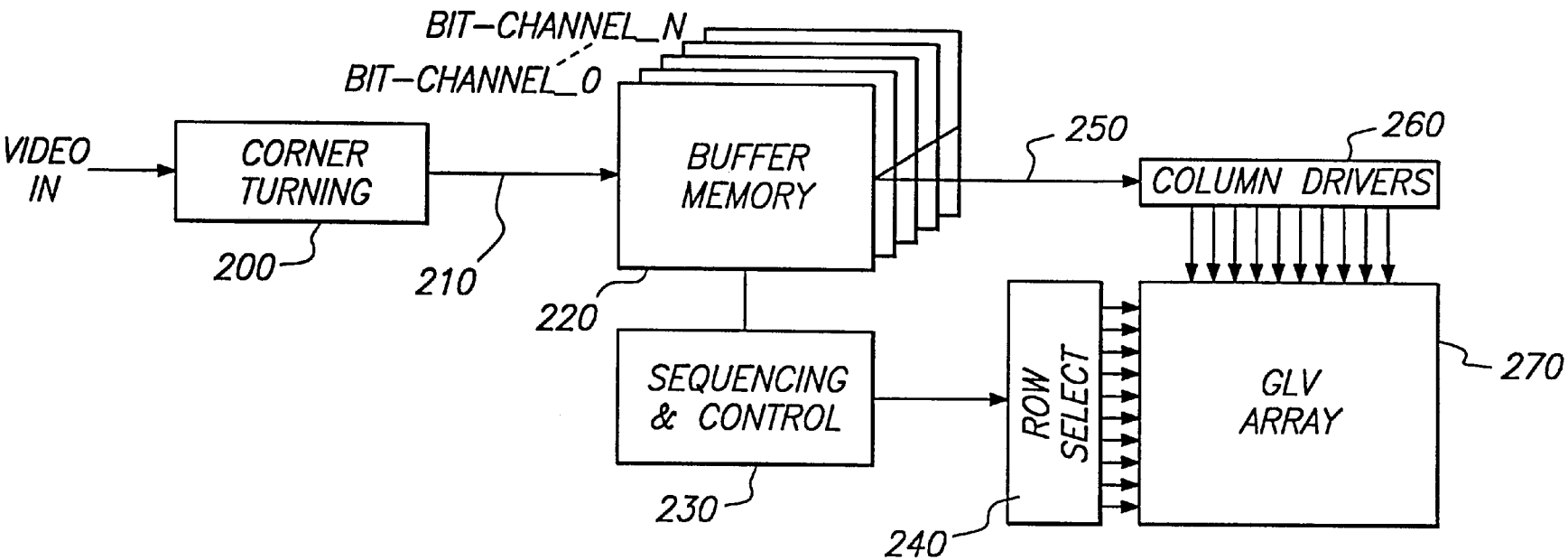
FIG. 2 is a generalized system block diagram of the invention.

FIG. 2 shows a block diagram of a generalized silicon light modulator display system according to the present invention. An incoming conventional video signal utilizing PWM is coupled to a corner turning circuit 200. In the preferred embodiment, the video signal utilizes binary radix encoding for the weighting of the several bits; there are N bits of weighting. According to conventional practice, the incoming video signal is organized to provide all the bits for a single pixel before providing any bits for a next pixel.

The silicon light modulator display 270 of the present invention is preferably a GLV such as disclosed in U.S. Pat. No. 5,311,360. This GLV is configured to update the display data simultaneously to an entire row; all the bits for a like-weighted PWM bit are simultaneously updated. The updating scheme preferably follows the teachings of our prior application Ser. No. 08/635,479, filed Apr. 22, 1996. According to that invention, the groups or rows are not concurrently updated but rather follow an algorithm to reduce the bandwidth requirements of the loading the display data. Further, generally bits of different weights are coupled to non-adjacent rows of the display in successive update operations. Thus, it is necessary to collect like-weighted bits in group partitions.

The corner turning circuit 200 is configured for splitting incoming video data words amongst N bit channels. This circuit collects a group of bits destined for the same bit channel where the group's size depends on bandwidth constraints and buffer memory data word size. Implementation of this bit channel separation can be any convenient method as is well known in the field of bit-plane oriented computer display systems (e.g. some International Business Machines Video Display Adapter, or "VGA" modes), or in the field of computer matrix arithmetic where transpose functions can necessitate an equivalent reordering. The transpose function interchanges the array access order between rows and columns (swapping axes) or, specifically in the present invention, between orthogonal axes of an array of bits such that groups of bits of the same weight are output together (taken as a slice through a collection of words). Hence, here and elsewhere the function is referred to as 'corner turning'. In its most reduced form, this function is one of mulitplexing (selecting) one bit at a time. More typically however, it will include an 10 bit by 8 bit array of registers with which are sequentially loaded with 8 words from a word-wide bus and, once filled, read out in the other direction on another byte wide bus as 10 bytes. In summary, its function is a partial reordering in time in order to match memory data bus widths. This temporal reordering is completed down stream by the buffer memories to affect the interfacing of video input ordering and silicon light modulator update ordering.

Data output from corner turning block 200 is coupled to a data bus 210 which in turn is coupled to N buffer memories 220 under control of sequencing and control logic 230. The data bus 210 that is coupled between the corner turning circuit 200 and the buffer memories 220 can be chosen to be of a width appropriate for the video bandwidth and circuit speeds, and affects the corner turning circuit size as indicated above. Most conveniently, bus widths throughout the system will be 8, 16 or another power-of-two bits wide, and data of different weights, bit channels, or color component may be time multiplexed in order to reduce hardware as appropriate. It will be apparent to one of ordinary skill in the art that a small amount of additional buffering and control circuitry overhead may be required between blocks in specific implementations depending on the subdivisions of the silicon light modulator array into pixels groupings, bus widths in general, data serialization, and other implementation details. To avoid obscuring the present invention in unnecessary and extraneous detail, this overhead is only outlined here and it will be understood that such alternate implementations are also contemplated within the teachings of the invention.

The buffers memories 220 can be conveniently organized as circular buffers of varying length packed into one or more physical memory devices with a static allocation of space using conventional techniques. The buffer memories 220 can be any convenient memory type including, but not limited to, semiconductor memory such as DRAM, SRAM, FIFO, shift registers or VRAM.

According to the present invention, buffer size will vary greatly from one bit channel to the next and as will become apparent, its relative size is related to the PWM bit weight. This provides the opportunity of using a hierarchical memory arrangement or "caching" of some channels. A small (and therefore low cost) memory block incorporated into the same chip as the timing data path circuits can greatly lessen the bandwidth requirements to external buffer memory (bulk DRAM for example) thereby lowering overall system costs and power consumption in some applications. For example, consider a 2 bit PWM binary radix scheme. Half the bits for displaying a frame are short bits and half are long bits. As the conventional video data streams in, groups or rows of data are received. Because of the algorithmic nature of the techniques taught in our prior patent, after the data for a row (or video line) has been received, the short duration bits may be coupled immediately to the display, while the longest duration bits must be stored for one quarter of the frame period. Thus, while only one line of storage is required for the short duration bits, many lines (one quarter of the vertical total) of buffering are required of the longest duration bits.

In an 8-bit per pixel, binary weighted PWM system, the four least significant bit channels require approximately 6% of system buffer memory and 50% of the system bandwidth. It is well known that bandwidth across the boundaries of semiconductor chips is very much more expensive than internal bandwidth, while the cost per bit of memory on logic circuits (e.g. ASICs) is very much higher than commodity memory devices (e.g. DRAM). Furthermore, faster memory devices tend to have smaller capacities. The trade off in a particular implementation can be made by the designer to optimize the desired system parameters.

The present invention has been designed for inclusion into a display system that includes a plurality of pixels arranged in an array of rows and columns. The system includes a silicon light modulator 270 of the GLV type, with 1024 rows of pixels, each having 1280 pixels arranged in columns. In an update cycle, a row of 1280 registers forming column drivers 260 is loaded with the display data from a bit channel buffer memory 220 under control of sequencing and control logic 230. Row drivers 240 select a complete row of pixels that is to be updated with the column data provided by 260 and thereby the data is written into the silicon light modulator 270. This process repeats according to the addressing scheme described below.

Our prior patent application Ser. No. 08/635,479, filed Apr. 22, 1996 describes the preferred PWM addressing scheme which includes the advantages of reduced bandwidth and greater flexibility in the ordering and choice of magnitude for PWM weights (time periods). Additionally, the following properties are also provided:

i) for each PWM bit weight, data is displayed in the same sequence as it arrives;

ii) for each bit channel, the delay between data arriving and display is constant;

iii) PWM segments (bit weights) may be displayed in any order.

These properties are used to advantage in the present invention in the following ways. The interrelated properties i) and ii) are used such that the number of bit channels required is equal to the grayscale word size—only 10 in the preferred embodiment. Due to property ii), constant delays may be implemented with relatively simple circular buffers and consequently less control and sequencing logic: for each data item read, one is written. The only substantial difference between bit channels is the delay implemented and hence the size of the circular buffer.

Figure 3:
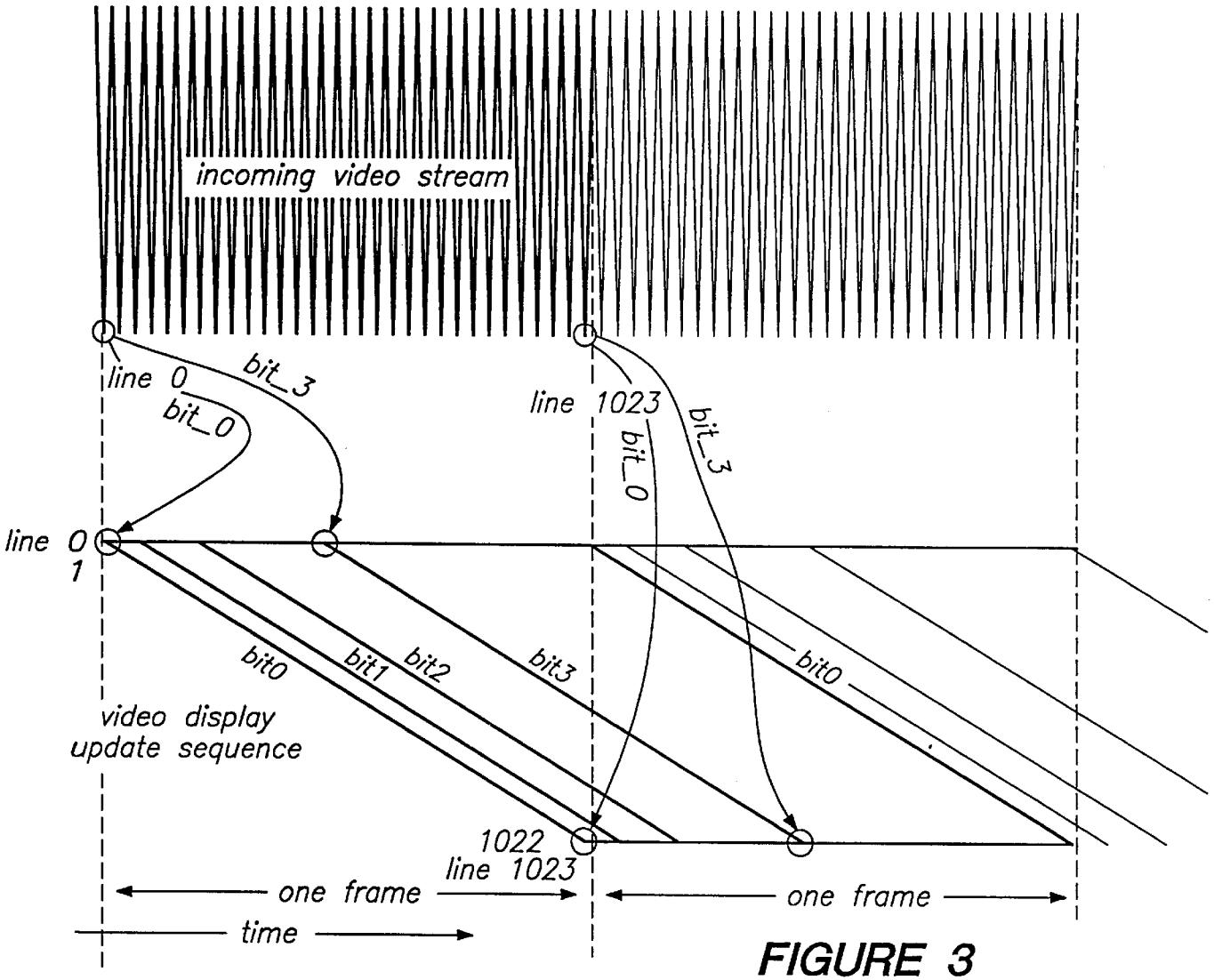
FIG. 3 illustrates the temporal relationship between incoming video data and output of that data in binary-weighted silicon light modulator updates in a preferred embodiment of the invention with 4-bit grayscale.

FIG. 3 illustrates the preferred addressing scheme relating video input sequence to silicon light modulator update sequence in a 1024 silicon light modulator row, 1024 video line system. In this diagram 4-bit binary weighing is shown for clarity. It will be noted that each bit channel requires only a buffer size proportional to the sum of the preceding bit weights in the PWM sequence—the time data must be queued waiting for previous bits to be displayed. More exactly, $$\text{Storage required for bit-channel } n = \sum_{i=0}^{i=n-1} Wi \cdot L$$

$$\text{Total required system storage} = \sum_{j=1}^{j=N} \sum_{n=1}^{n=j-1} Wi \cdot L$$

Where Wi is the weight of the i-the bit in terms of video lines (the data's duration expressed as a multiple of the video line period), N is the number of bit channels, and 1 is the number of pixels per line. The result is in bits.

In the preferred embodiment of the invention, property iii) is used to further minimize the sum total of buffer memories' sizes by choosing to display LSBs first and MSBs last, and by choosing binary weighted PWM. In other words, as soon as a group of LSBs are collected they can be coupled to the display so that no additional storage is required. In this 1024×1280 10-bit per-color-channel system, the LSB (bit channel 0) needs one line of buffering (1280 bits) for each color channel, bit-channel 1 requires 2 lines, bit-channel 2 requires 4 lines, and so on up to 512 lines for bit 9; total buffer memory required is 3×1023×1280 bits (RGB color) or less than one twentieth of the prior art's double-buffered requirement; less than 512 Kbytes versus 10 Mbytes. This is a significant reduction in the size of the buffer memory.

To illustrate exactly the buffer memory contents change along with input to output sequencing, consider a hypothetical (simplified) 16-line video, 4-bit grayscale sequence for a GLV. Since 1 (the number of pixels per line) is a given constant, the hypothetical is cast in terms of "bits-lines" and applies to a GLV of any horizontal resolution. The hypothetical indicates for each incoming video line, the four corresponding silicon light modulator updates—one for each bit channel—and what data is stored in the bit channel buffers. For instance, all bit 2's from video line 3 are used in an update during video line 7 and bit channel 2 buffer needs to be 4 lines long. This use of buffer memory comports with the bandwidth improvements and addressing scheme disclosed in detail in our co-pending application Ser. No. 08/635,479, filed Apr. 22, 1996.

OTHER EMBODIMENTS

Many characteristics of a video system may be optimized to benefit various parameters such as perceived frame flicker, other psycho-visual effects, light efficiency, cost, physical attributes, and so on. The preferred embodiment has been described with reference to a 1024×1280 video format where the number of lines in the incoming format is a power of 2 and does not include such possible complications as blanking periods (horizontal and vertical "flybacks"). The following is included to illustrate dimensions of design flexibility of the present invention and additional details.

Figure 4:
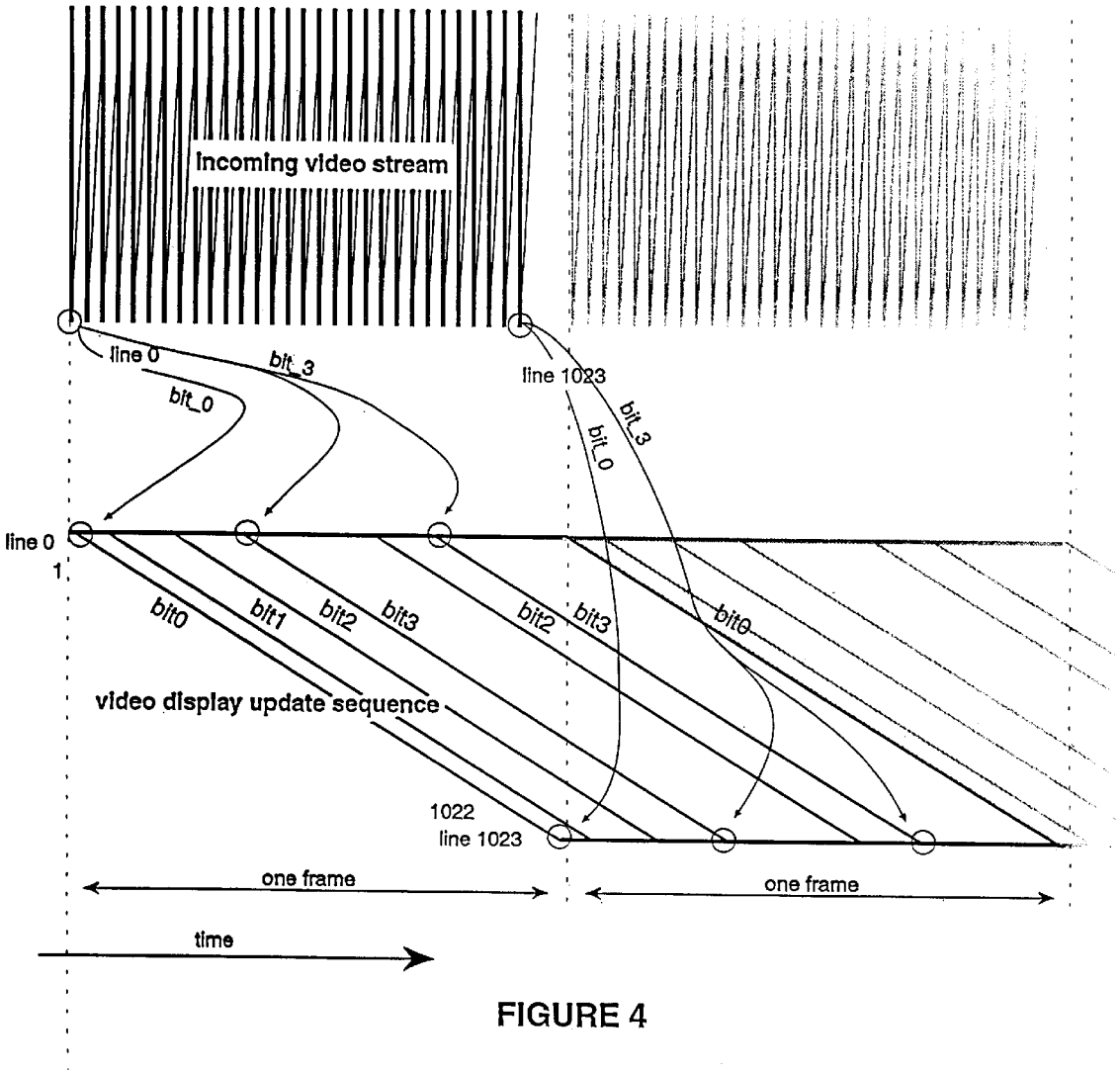
FIG. 4 illustrates an update sequence with non-binary weighted time segments.

Under certain circumstances PWM weightings are not chosen to be power of two or to be a degenerate power of 2. For instance, in order to reduce flicker due to degenerate data patterns, top-bit splitting has been used as disclosed in our co-pending application Ser. No. 08/635,479, filed Apr. 22, 1996. FIG. 4 illustrates a timing diagram. Here, the 2 MSBs are split in half and alternately displayed. In this example applied to a 1024-line display, the MSBs require 640 and 768 lines instead of 256 and 512 lines of buffering respectively, for a total of 1663 lines as opposed to 1023. This is still much reduced relative to the prior art and bandwidth saving available from caching LSBs. The equations above are consistent non-power of two weightings. Note, also, that bit channel buffers for the MSBs are now written once, but read twice each and therefore require somewhat more complex sequencing.

Figure 5:
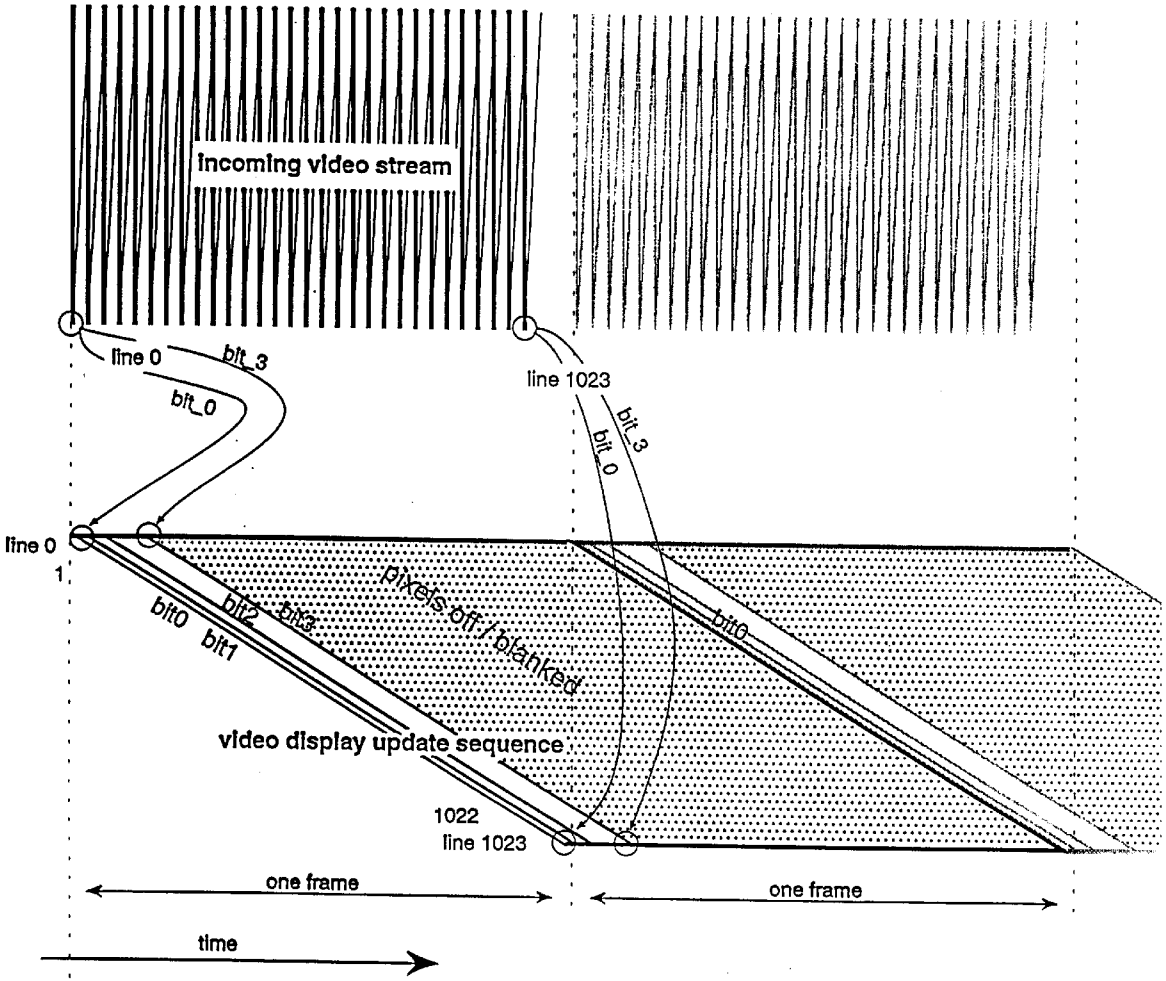
FIG. 5 illustrates an update sequence with dead time or blanking.

Horizontal blanking in incoming video signals represents little problem since small FIFOs may be used to smooth data rates. However, vertical blanking has a far longer duration and can require substantial buffering. For instance, an incoming video signal with 40 lines of vertical blanking will require up to 40 lines of storage for each bit channel in order to rate match input to output. Although this does not overly increase the total system memory requirement, caching of LSBs becomes far more expensive. A solution to this problem is to include in the PWM sequence a corresponding blank period equal in length to the incoming video's blanking. This method can also be applied to systems where the incoming video has a non-power-of-two number of active lines, but the PWM scheme does have a binary weighting. In the extreme, a blanking period that consumes a large portion of the display period or frame time, requires bit channel buffers of much reduced length and thereby reduces systems memory compared to the preferred embodiment. This is illustrated in FIG. 5. Disadvantages of having extended blanking periods are reduced light efficiency and contrast ratio when a silicon light modulator is evenly illuminated. However, where the light source can be arranged to scan the array in synchrony with the active area (non-blanked stripe of pixels), little loss in light efficiency or contrast ratio is incurred. Advantages of a long deadband include elimination of perceived flicker for degenerate data patterns without resorting to bit splitting, and reduction of color breakup artifacts (caused by relative movement of the displayed image in the viewer's field of view) in frame sequential color (FSC) systems.

Figure 6:
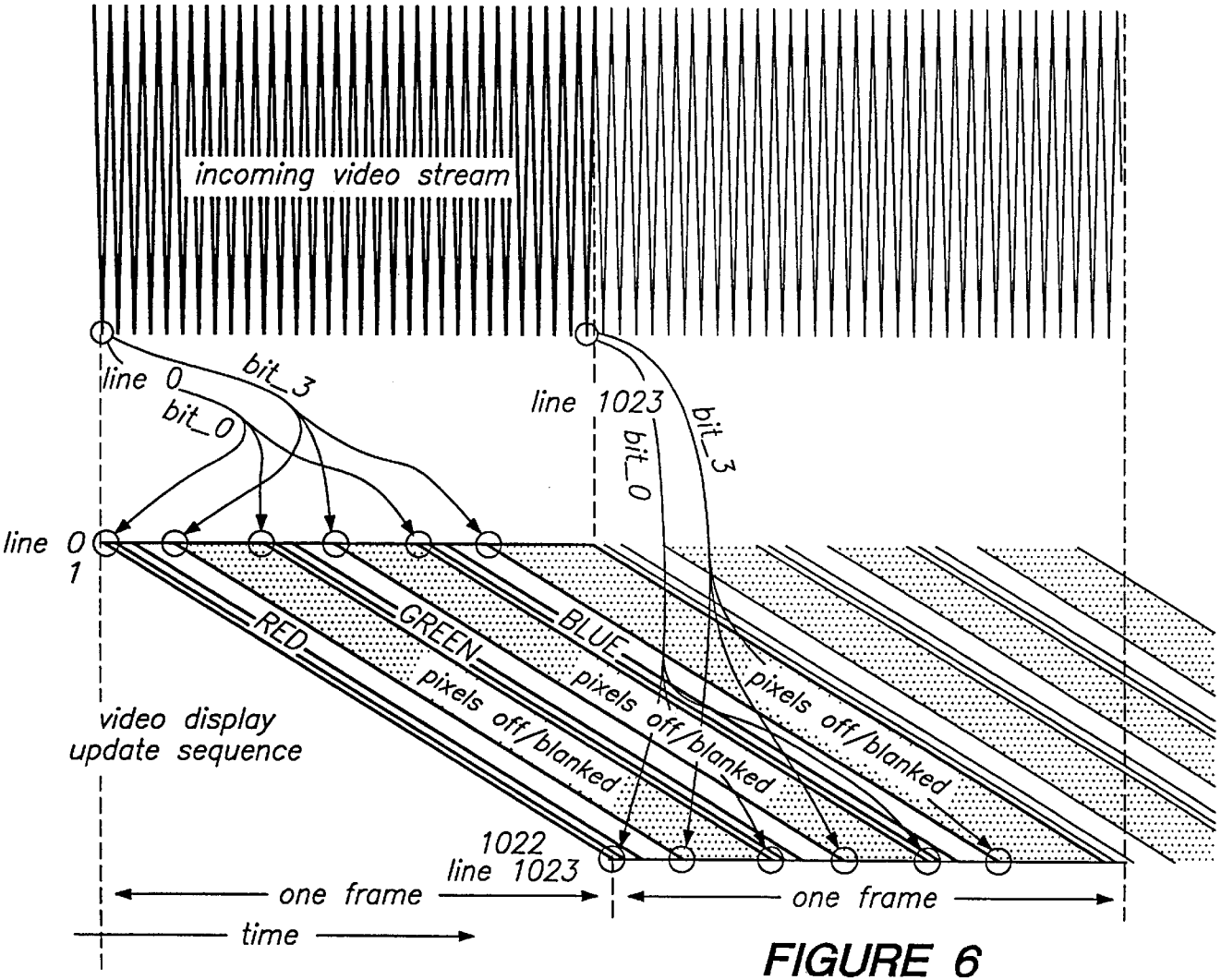
FIG. 6 illustrates an update sequence of a frame-sequential-color system.

It is well known that (FSC) techniques may be applied to color display systems in order to lower system costs. In a FSC system, a single silicon light modulator replaces the three silicon light modulators, and red green and blue components are displayed sequentially instead of simultaneously. FIG. 6 illustrates a possible implementation of the invention to affect FSC systems. In the most direct form, this implementation is equivalent to a non-power of two PWM scheme with several deadbands. The deadbands may be included to avoid overlapping illumination color components on active pixels.

Figure 7:
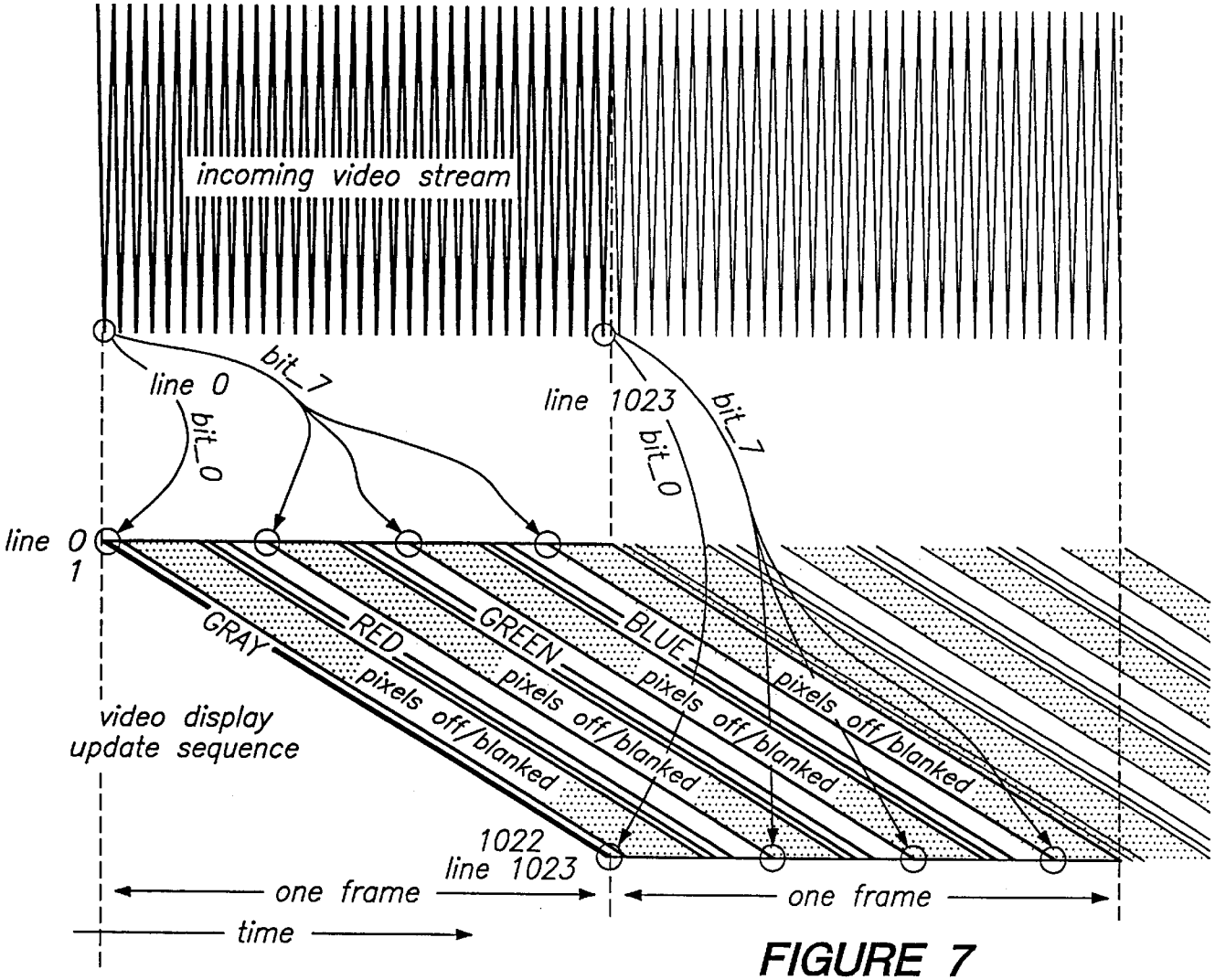
FIG. 7 illustrates an update sequence of a gray-subcoding FSC system.

FIG. 7 illustrates an improved system relative to system storage requirements wherein four bands are used and the first band displays LSB information (for instance, bit weights 0 to 5) while the remaining three bands display RGB information as before (remaining bit weights 6–9). This first band is displayed in gray, with the magnitude of the RGB LSBs summed and some color information lost. (The human eye is less sensitive to chrominance than luminance degradation in picture quality.) Such gray subcoding reduces by nearly a factor of three the storage requirement for LSBs and as such is a useful technique to reduce cache size. Similarly, the frame time can include two bands for each color component, with an earlier display of LSB information for all colors.

It will be clear that the reduction of memory size and bandwidth can be achieved for other embodiments that have different arrangements from the line-sequential video input arrangement of the preferred embodiment. It is therefore, considered that the appended claims will apply to all modifications that lie within the scope of the invention.

What is claimed is:

1. A method of converting a stream of incoming serial video data, formatted with each pixel's data arriving concurrently, into digital PWM video formatted as a sequence of groups of like-weighted bits comprising the steps of:

a. receiving the stream of incoming serial video data for displaying a series of frames, each frame defined by a predetermined number of bits;

b. storing the data in a memory within a plurality of buffers such that it can be accessed as like-weighted bit groups and each buffer implements a constant delay; and c. organizing collections of groups in the memory such that less than the predetermined number of bits need be concurrently stored in the memory.

2. A method of converting a stream of incoming serial video data organized with all data for a single pixel transmitted concurrently into digital PWM video organized into groups of like-weighted bits comprising the steps of:

a. receiving the stream of incoming serial video data for displaying a series of frames, each frame defined by a predetermined number of bits;

b. storing the data in a memory such that it can be addressed as like-weighted bits; and c. displaying a short duration group on a display device as the group is completed such that less than the predetermined number of bits need be concurrently stored in the memory.

3. The method according to claim 2 wherein less than an entire frame of data is stored in memory.

4. The method according to claim 3 wherein the stream of incoming serial video data includes a vertical blanking period further comprising the step of forming a deadband in a display to coincide with the vertical blanking period.

5. The method according to claim 4 further comprising the step of displaying a portion of data during the deadband to further reduce the memory size.

6. The method according to claim 4 wherein the display device is a silicon light modulator having an illumination source.

7. The method according to claim 4 further comprising the step of scanning the illumination source to avoid the deadband.

8. An apparatus for converting a stream of incoming serial video data organized with all data for a single pixel transmitted concurrently into digital PWM video organized into groups of like-weighted bits comprising:

a. means for receiving the stream of incoming serial video data for displaying a series of frames, each frame defined by a predetermined number of bits;

b. means for storing the data in a memory such that it can be addressed as like-weighted bits; and c. means for displaying a short duration group as the group is completed in the memory such that less than the predetermined number of bits need be concurrently stored in the memory.

9. The apparatus according to claim 8 wherein the means for storing comprises an apparatus to segment the stream of incoming serial video data into bit planes, one for each weight of bit, such that a number of memory bits is required for each bit plane is proportional to a bit weight.

10. The apparatus according to claim 9 wherein the memory is formed of RAM.

11. The apparatus according to claim 9 wherein less than an entire frame of data is stored in memory.

12. The apparatus according to claim 11 wherein the stream of incoming serial video data includes a vertical blanking period further comprising means for forming a deadband in a display to coincide with the vertical blanking period.

13. The apparatus according to claim 12 further comprising means for displaying a portion of data during the deadband to further reduce the memory size.

14. The apparatus according to claim 12 wherein the display device is a silicon light modulator having an illumination source.

15. The apparatus according to claim 12 further comprising means for scanning the illumination source to avoid the deadband.

16. An apparatus for converting a stream of incoming serial video data, wherein the stream of incoming serial data is organized with all data for a single pixel transmitted concurrently into digital PWM video organized into groups of like-weighted bits comprising:

a. means for receiving the stream of incoming serial video data;

b. a digital memory coupled to receive the data;

c. a controller coupled to the memory for storing the data in a plurality of bit planes, each bit plane having only bits of like weight;

d. means for collecting portions of the bit planes into groups; and e. means for coupling a group of data to a display such that groups of a shortest duration bit weight are coupled to the display as they are formed, wherein less than an entire frame of data is stored concurrently within the digital memory.

17. The apparatus according to claim 16 wherein the means for storing comprises an apparatus to segment the stream of incoming serial video data into bit planes, one for each weight of bit, such that a number of memory bits is required for each bit plane is proportional to a bit weight.

18. The apparatus according to claim 16 wherein the memory is formed of RAM.

19. The apparatus according to claim 18 wherein less than an entire frame of data is stored in memory.

20. The apparatus according to claim 19 wherein the stream of incoming serial video data includes a vertical blanking period further comprising means for forming a deadband in a display to coincide with the vertical blanking period.

21. The apparatus according to claim 20 further comprising means for displaying a portion of data during the deadband to further reduce the memory size.

22. The apparatus according to claim 20 wherein the display device is a silicon light modulator having an illumination source.

23. The apparatus according to claim 20 further comprising means for scanning the illumination source to avoid the deadband.

24. The apparatus according to claim 19 wherein a portion of the memory is formed of cache.

* * * * *

UNITED STATES PATENT AND TRADEMARK OFFICE

CERTIFICATE OF CORRECTION

PATENT NO. : 6,064,404

DATED : May 16, 2000

INVENTOR(S) : Richard John Edward Aras; Paul A. Alioshin

It is certified that error appears in the above-identified patent and that said Letters Patent is hereby correct as shown below:

On the Title Page:

IN REFERENCES CITED; U.S. PATENT DOCUMENTS

| | | | | |
|---|---|---|---|---|
| Please insert: | --4,649,432 | 1/1985 | Watanabe et al. | 358/24-- |
| | --4,882,683 | 3/1987 | Rupp | 364/521 -- |
| | --4,924,413 | 5/1987 | Suwannukul | 364/521 -- |
| | --5,043,917 | 6/1989 | Okamoto | 364/518 -- |
| | --5,307,056 | 9/1991 | Urbanus | 340/189 -- |
| | --5,497,172 | 6/1994 | Doherty et al. | 345/85 -- |
| | --5,534,883 | 4/1993 | Koh | 345/3 -- |
| | --5,544,306 | 5/1994 | Deering et al. | 395/164 -- |

Signed and Sealed this

Twenty-seventh Day of March, 2001

*Attest:*

Nicholas P. Godici

NICHOLAS P. GODICI

*Attesting Officer*

*Acting Director of the United States Patent and Trademark Office*